US005320165A

United States Patent [19]

Hughes

[11] Patent Number: 5,320,165

[45] Date of Patent: Jun. 14, 1994

[54] HIGH PRESSURE, LONG LIFE, ALUMINUM HEAT EXCHANGER CONSTRUCTION

[75] Inventor: Gregory G. Hughes, Milwaukee, Wis.

[73] Assignee: Modine Manufacturing Co., Racine, Wis.

[21] Appl. No.: 39,701

[22] Filed: Apr. 1, 1993

Related U.S. Application Data

[63] Continuation of Ser. No. 940,184, Sep. 3, 1992, abandoned.

[51] Int. Cl.[5] ..... F28F 9/02

[52] U.S. Cl. ..... 165/153; 165/173

[58] Field of Search ..... 165/152, 153, 173; 29/890.052

[56] References Cited

U.S. PATENT DOCUMENTS

| | | | |
|---|---|---|---|
| 1,368,770 | 2/1921 | True | 165/173 |
| 4,401,157 | 8/1983 | Cadars | 165/173 |
| 4,709,689 | 12/1987 | Simcox | 126/448 |
| 5,092,398 | 3/1992 | Nishishita et al. | 165/153 |
| 5,127,466 | 7/1992 | Ando | 165/67 |

FOREIGN PATENT DOCUMENTS

| | | | |
|---|---|---|---|
| 766069 | 5/1954 | Fed. Rep. of Germany | 165/173 |
| 63-169499 | 7/1988 | Japan | 165/173 |
| 3-36497 | 2/1991 | Japan | 165/173 |
| 2049151 | 12/1980 | United Kingdom | 165/173 |

*Primary Examiner*—Allen J. Flanigan
*Attorney, Agent, or Firm*—Wood, Phillips, VanSanten, Hoffman & Ertel

[57] ABSTRACT

Low pressure resistance in a radiator for use in the cooling system of an internal combustion engine or other heat exchanger may be overcome in a construction including a core (20) defined by a plurality of elongated spaced, parallel tubes (26) with fins (28) extending between adjacent tubes, and header and tank assemblies (22, 24) at opposite ends of the core and attached thereto to be in fluid communication with the tubes (26). Each header and tank assembly (22, 24) includes an elongated housing (40, 104) including an interior passage (34) of circular cross-section and an external, generally planar surface (48, 98). Elongated recesses (46, 110, 112) are disposed in the exterior of the housing, one to each side of the planar surface (48, 98) and an elongated channel having spaced legs (56) interconnected by a base (54) is fitted to the housing with the base (54) abutted to or adjacent to the planar surface (48, 98) with the legs extending partially about the housing to be received in the recesses (46, 110, 112). Openings (52, 84, 103, 106) establish fluid communication between the passages (34) and the planar surface (48, 98) and a plurality of openings (60) in the base (54) sealingly receive the ends (70) of the tubes (26) in the core (20).

19 Claims, 4 Drawing Sheets

HIGH PRESSURE, LONG LIFE, ALUMINUM HEAT EXCHANGER CONSTRUCTION

This application is a continuation of Ser. No. 07/940,184, filed Sep. 3, 1992, now abandoned.

FIELD OF THE INVENTION

This invention relates to heat exchangers, and more specifically, heat exchangers for cooling the lubricating oil, the combustion air, or the coolant for internal combustion engines. It may also be used as a condenser in an air conditioning unit.

BACKGROUND OF THE INVENTION

So-called "radiators" are heat exchangers that are used to reject heat from the coolant of an internal combustion engine to the ambient. In a typical case, engine coolant is circulated through coolant passages in the engine block to the so-called liquid side of the radiator where it is cooled and then returned to the engine block. Cooling occurs by forcing ambient air through the radiator core as, for example, by a fan driven either by an electric motor or by a power take-off from the internal combustion engine itself.

In the usual case, the coolant systems are mildly pressurized to, for example, 7–16 psig. As a result, the coolant may heat to a temperature above its boiling point at atmospheric pressure without actually vaporizing. In this way, the wall temperature of the combustion chamber of the internal combustion engine may be maintained at a fairly constant value which is selected to maximize thermal efficiency of the engine while assuring that undue thinning of the lubricant film on relatively moving parts will not occur.

As elementary thermodynamics will demonstrate, the thermal efficiency of an engine increases as its operating temperature is increased. Consequently, it is desirable to raise the operating temperature of the engine as much as possible to maximize efficiency. If, however, the operating temperature is raised to the point where coolant within cooling passages in the engine begins to vaporize, pockets of vapor will develop and because the heat capacity of vapor usually is much less than the heat capacity of the liquid coolant, those parts of the engine contacted by the vapor will heat to undesirably high temperatures while adjacent parts contacted by liquid coolant will not. The resulting "hot spots" are undesirable from two standpoints. First, the "hot spot" may not be able to sustain an adequate lubrication film, resulting in poor lubrication and undue wear. Secondly, the temperature differential between the "hot spot" and other parts of the engine may ultimately result in damage to engine parts as, for example, warpage of reciprocating engine heads. Consequently, if engines are to be operated at higher temperatures, it is necessary that the boiling point of the coolant being employed be raised.

This, of course, can be done by increasing system pressure. For example, an increase in maximum system pressure from approximately 8 psig to 63 psig would increase the boiling point of a coolant such as water some 70 degrees fahrenheit.

At the same time, it becomes necessary to increase the strength of the radiator so that the same may operate at the increased pressure.

The present invention is directed to providing an improved high pressure resistant radiator.

SUMMARY OF THE INVENTION

It is the principal object of the invention to provide a new and improved heat exchanger. It is also an object of the invention to provide a new and improved heat exchanger that may operate at relatively high pressures as a radiator for an internal combustion engine cooling system.

An exemplary embodiment of the invention achieves one or more of the foregoing objects in a heat exchanger including a core defined by a plurality of elongated, parallel spaced tubes with fins extending between adjacent tubes. A header and tank assembly is at least one end of the core and attached thereto in fluid communication with the tubes. The header and tank assembly includes an elongated housing having an interior passage with a cross-section defined by a closed curve and an exterior, generally planar surface. Elongated recesses are disposed in the exterior of the housing, one to each side of the planar surface. An elongated channel having spaced legs interconnected by a base is provided and the channel is fitted to the housing with the base abutted to or adjacent the planar surface. The channel legs extend partially about the housing to be received in the recesses. Means are provided to establish fluid communication between the passage and the planar surface, and a plurality of openings are disposed in the base of the channel and tightly and sealingly receive the ends of the tubes in the core.

In this embodiment of the invention, the tubes are flattened tubes and the openings are elongated slots surrounded by flanges.

Preferably, the establishing means are made up of elongated slots in the planar surface and the flanges are received in corresponding ones of the elongated slots in the planar surface.

In a highly preferred embodiment, the housing is generally in the shape of an "O" with a bar tangent thereto The invention contemplates that the elongated slots in the planar surface be curved and concave whereas in another embodiment, the elongated slots in the planar surfaces have flat bottoms.

According to the invention, there may also be provided a high pressure resistant aluminum radiator for cooling the coolant of an internal combustion engine which comprises a pair of generally cylindrical aluminum tubes. The tubes are spaced and parallel to one another and end caps are brazed within respective ends of the tubes to seal the same. An elongated aluminum spacer is disposed on each of the tubes and extends along the length thereof. The spacer on one of the tubes faces the spacer on the other of the tubes and a plurality of spaced slots are disposed in each spacer. The slots in each spacer are parallel and generally transverse to the direction of elongation of the associated spacer. Further, the slots in one spacer are aligned with the corresponding slots on the other spacer. Means are provided for establishing fluid communication between the corresponding tubes in each of the slots of the associated header and a channel-shaped aluminum header is fitted about and brazed to each of the spacers. Each channel has a base provided with a plurality of apertures surrounded by flanges with the apertures being aligned with the corresponding slots in the associated spacer such that the flanges enter the corresponding slots. A plurality of flattened aluminum tubes are received in and extend between aligned apertures in the headers.

The ends of the flattened tubes are brazed to the flanges surrounding the apertures in which they are received. The tubes also include internal webs for increased pressure resistance and a plurality of serpentine, aluminum fins extend between and are brazed to adjacent ones of the tubes.

In one embodiment, the spacers are integral with the corresponding tube while in another embodiment, the spacers are formed separately from the tubes and assembled thereto by brazing.

In the embodiment wherein the spacers are integral with the corresponding tube, the tube and the spacers are defined by a single extrusion.

In one embodiment, the slots are formed by circular saw cuts which further define the establishing means. In another embodiment, the slots are formed by end mill cuts which further define the establishing means.

Other objects and advantages will become apparent from the following specification taken in connection with the accompanying drawings.

DESCRIPTION OF THE PREFERRED EMBODIMENTS

Figure 1:
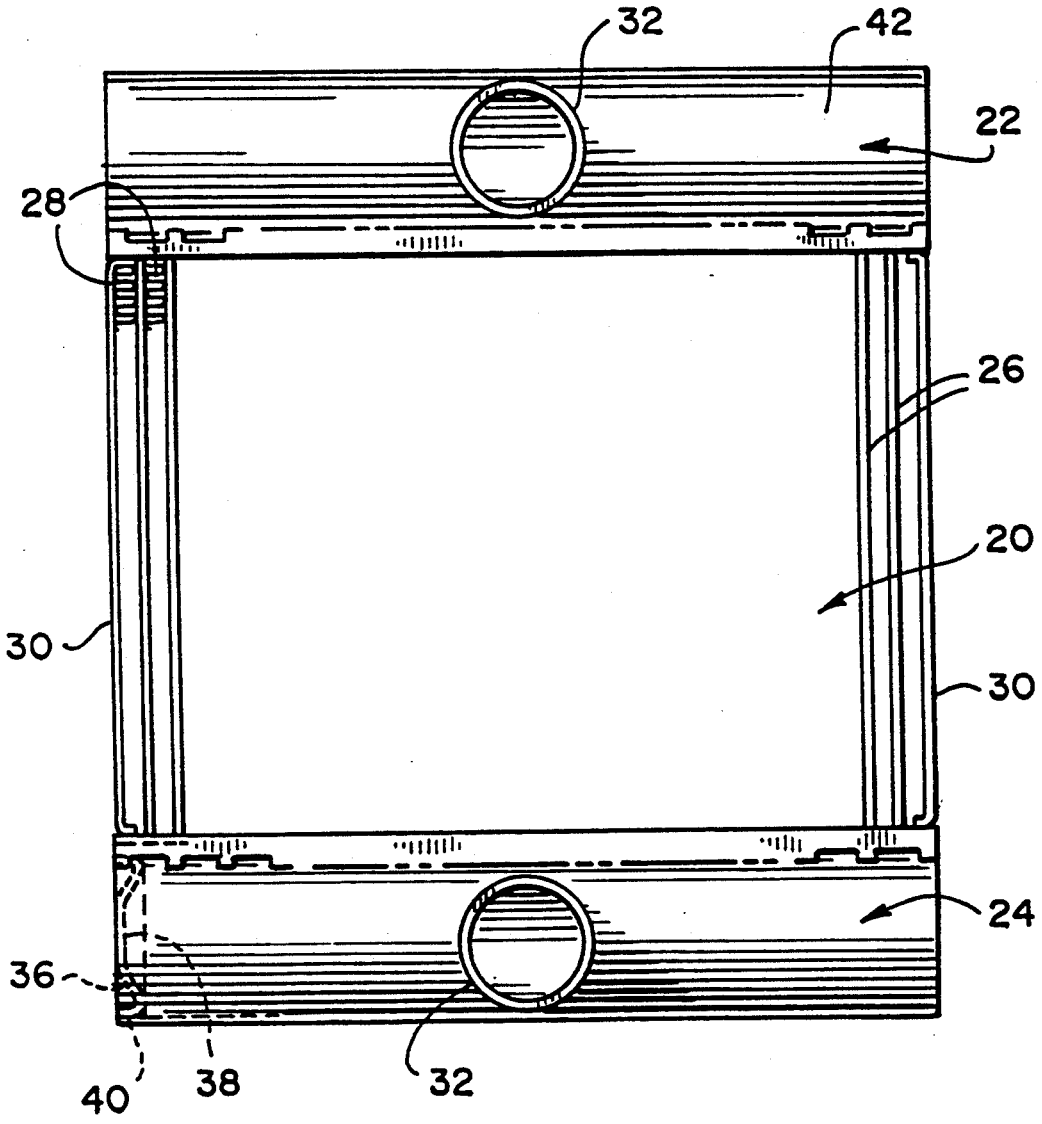
FIG. 1 is a front elevation of a heat exchanger made according to the invention.
Figure 2:
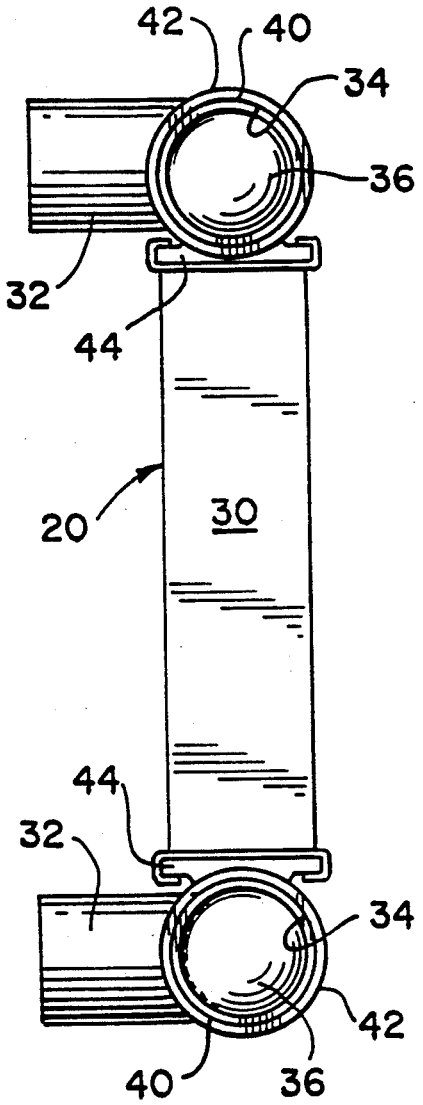
FIG. 2 is a side elevation of the heat exchanger taken from the right of FIG. 1.

An exemplary embodiment of a high pressure resistant radiator made according to the invention is illustrated in FIGS. 1 and 2, and is seen to include a radiator core, generally designated 20, sandwiched between upper and lower header assemblies, generally designated 22 and 24 respectively. Of course, the header assemblies 22 and 24 could be on the sides of the core 20 rather than on the top and bottom as is well known. That is to say, the core may be part of either a cross flow or down flow radiator. It is also to be observed that the upper and lower header assemblies 22 and 24 are mirror images of one another so that only one will be described.

Returning to the core 20, the same is made up of a plurality of parallel, flattened tubes 26 of a construction to be described hereinafter. Preferably, the tubes 26 are formed of aluminum and serpentine, aluminum, louvered fins 28 of known construction extend between and are bonded to as by brazing to adjacent ones of the tubes 26. At the ends of the core 20, aluminum side pieces 30 extending between the headers and may be located and brazed to the fins 28.

Each of the header assemblies 22 and 24 includes an inlet or outlet port 32 that is in fluid communication with an interior, elongated passage 34 which has the cross-sectional shape of a closed curve, specifically, a circle. That is to say, the internal passage 34 will be cylindrical in the usual case. This configuration is chosen to provide maximum resistance to pressure although it will be appreciated that good pressure resistance can be obtained with non-circular closed curve cross-sections and that such non-circular cross-sections may be employed in some cases to meet spacial constraints or the like.

Opposite ends of the passages are closed by end caps 36. As seen in FIG. 1, each end cap has a partially spherical center section 38 surrounded by a peripheral flange 40. The flange 40 is snugly received within the corresponding end of each of the passages 34 and sealingly bonded thereto as, for example, by brazing.

Each of the header assemblies 22, 24 is preferably defined by a tubular shape or tube 42 mounting a spacer 44. The spacer may either be integral with the associated tube 42 or separate therefrom but bonded thereto as will be seen. In any event, the cross-sectional configuration is that of an "O" with a "bar" tangent thereto. As seen in FIG. 2, the spacers 44 face one another.

Figure 3:
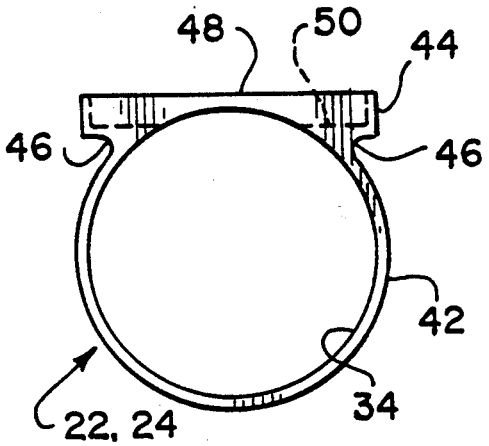
FIG. 3 is an enlarged view of a header and tank assembly used in the heat exchanger.
Figure 4:
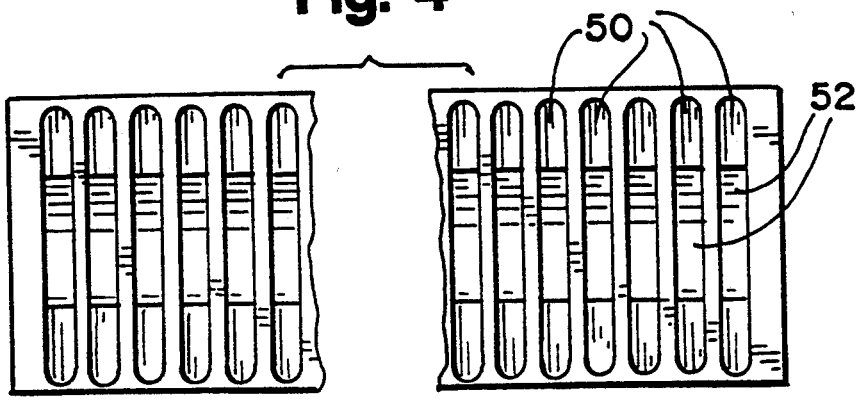
FIG. 4 is another view of the header and tank assembly taken from the left of FIG. 3.

Turning now to FIGS. 3 and 4, an embodiment of the invention wherein the tube 42 and spacer 44 are integral is illustrated. In this embodiment, the two will typically be formed by extrusion in the configuration illustrated in FIG. 3 and this, in turn, will result in a pair of elongated recesses 46 extending along the length of the header assembly at the junction of the spacer 44 with tubular shape 42.

The spacer 44, on the side thereof remote from the tube 42, includes a planar surface 48. Within the planar surface, a plurality of flat-bottomed recesses 50 are formed as by end bar milling, back extrusion, etc. As can be seen in both FIGS. 3 and 4, the recesses 50 intersect the passage 34 so that openings 52 through the spacer 44 to the interior of the tube 42 are formed. The recesses 50 are on the same centers as the flattened tubes 26 (FIG. 1) in the core 20.

Figure 7:
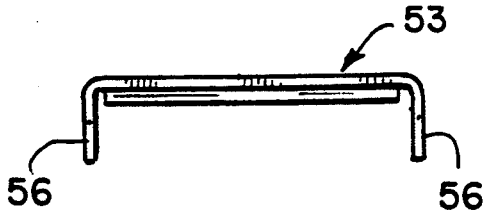
FIG. 7 is a side view of the channel from the left of FIG. 5.
Figure 6:
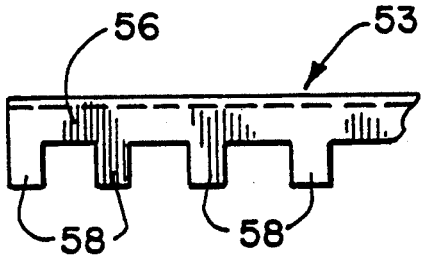
FIG. 6 is a top view of the channel.
Figure 5:
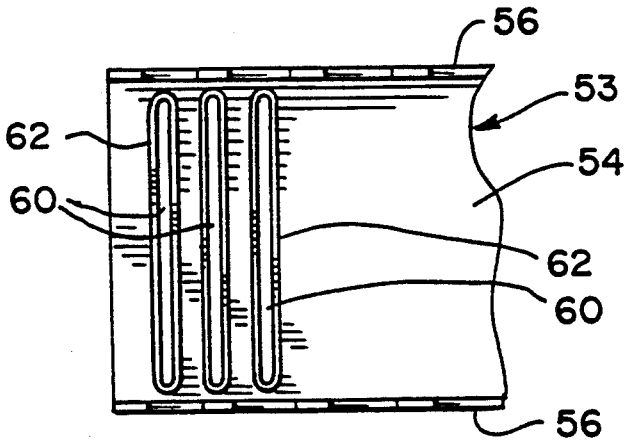
FIG. 5 is a plan view of a channel employed as a header plate.

Turning now to FIGS. 5, 6 and 7, a header plate in the form of a channel 53 is shown. The header plate includes a base 54 flanked by two upstanding legs 56. As seen in FIG. 6, the legs 56 have fingers 58 disposed along the length of the channel 53. As seen in FIG. 5, the base 54 is provided with a plurality of slots 60. The slots 60 are located on the same centers as the tubes 26 and are surrounded by peripheral flanges 62. The flanges 62 are sized to fit within the recesses 50 in the spacer 44 (FIGS. 4 and 5). At the same time, the slots 60 are sized to snugly received respective open ends of 70 of the tubes 26.

In practice, the channel 53 is fitted over a corresponding one of the spacers 44 such that the flanges 62 surrounding the slots 60 enter the recesses 50 in the spacer 44. The fingers 58 are bent about the spacer 44 into the recesses 46 to clamp the header plate to the spacer. The tube ends 70 are, of course, located in the slots 60. In the usual case, the assembly will be bonded together with the various interfaces sealed by a brazing process. To this end, preferably all of the previously described components are formed of aluminum and, where necessary to effect a braze, coated with braze clad.

Figure 9:
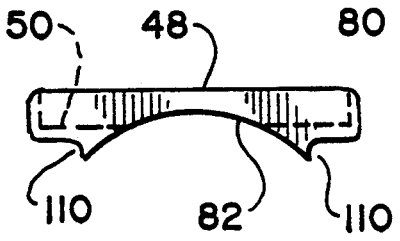
FIG. 9 is a view of a modified embodiment of a spacer.
Figure 10:
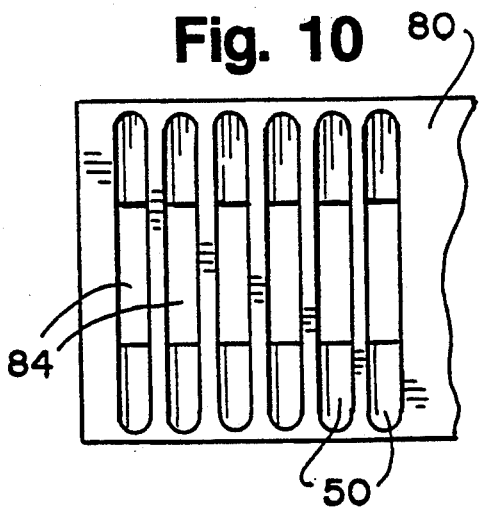
FIG. 10 is a view of the spacer of FIG. 9 taken from the left thereof.

In some instances, rather than forming the tube 42 and spacer 44 integrally by an extrusion, it may be desirable to form the spacer separately from the tube and subsequently assemble the two together. FIG. 9 illustrates a spacer 80 of this sort. The spacer 80, like the spacer 44, includes a plurality of end-milled recesses 50 in a planar side 48 thereof. The side of the spacer 80 opposite the planar side 48 is provided with an elongated, relatively shallow, concave recess 82 having the same radius as a separate tube 42 to be fitted thereto. It will be observed that the location of the recess 82 in relation to the end-milled recesses 50 is such that the same intersect to form a series of openings 84 (FIG. 10) through the spacer 80.

Figure 11:
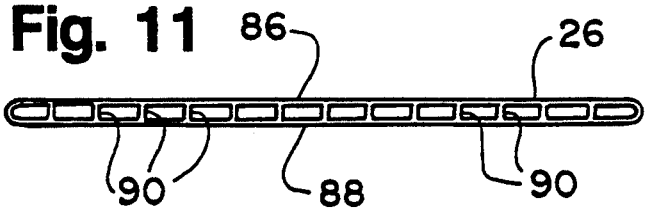
FIG. 11 is a sectional view of a tube used in the heat exchanger.

FIG. 11 illustrates the cross-section of a typical one of the tubes 26. As can be seen, the same has opposed, flat sides 86 and 88 and thus is what is known in the art as a "flattened tube". Within the tube 26, at various locations along its major dimension, there are a plurality of internal webs 90 which extend between the flattened walls 86, 88 to thereby strengthen the tube 26 against internal pressure. In the illustrated embodiment, the webs 90 may be formed with the tube integrally by an extrusion process. In some instances, however, the tubes may be fabricated with the webs 90 being formed by separate inserts as, for example, disclosed in commonly assigned U.S. Pat. No. 4,688,311 issued Aug. 25, 1987 to Saperstein et al., entitled "Method Of Making A Heat Exchanger" the details of which are herein incorporated by reference.

Figure 12:
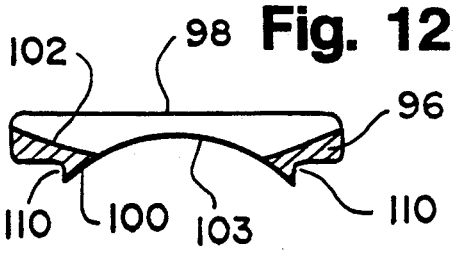
FIG. 12 shows still another embodiment of a spacer.

In some instances, the use of recesses 50 formed by end mill cutting may be undesirable from the manufacturing standpoint. In this case, a spacer 96 as shown in FIG. 12 used. The spacer 96 is, of course, elongated and will have a planar surface 98 on one side and an opposite, relatively shallow, concave surface 100 whose radius is identical to the radius of the tube to which the spacer 96 is to be assembled. In this embodiment of the invention, recesses 102 corresponding to the recesses 50 are formed by circular saw cuts in the planar surface 98 at the desired intervals. The recesses 102 are cut to a sufficient depth to intersect the recess defined by the surface 100 to form slot-like openings 103 establishing fluid communication across the spacer 96.

Figure 13:
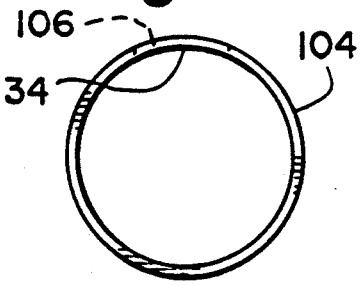
FIGS. 13 and 14 are two views of header tubes that may be used with the embodiment of FIG. 12.
Figure 14:
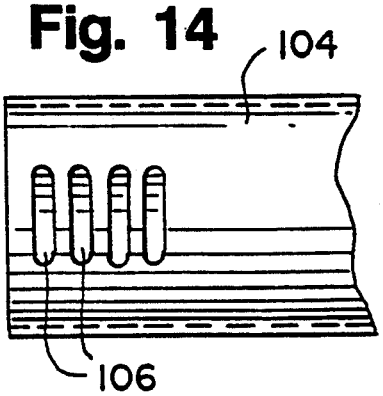

Typically, a cylindrical tube 104 such as shown in FIG. 13 may be provided with a plurality of parallel slots 106 (FIGS. 13 and 14) on the desired centers. The tube 104 may then be assembled to a spacer such as those illustrated in FIGS. 9, 10, and 12 with the slots 106 aligned with the openings 84, 103. The tube 104 is then bonded to the spacer 80 or 96.

Figure 8:
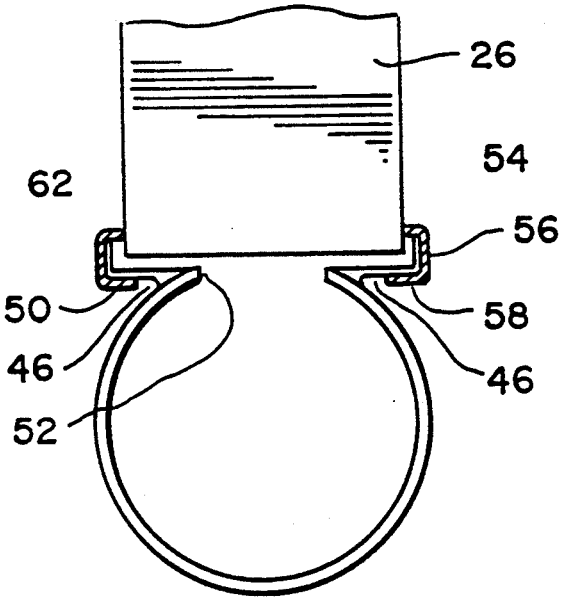
FIG. 8 is an enlarged view of one end of the heat exchanger.

It is to be particularly noted that in both FIGS. 9 and 12, the relationship of the ends of the spacer 80, 96 to the elongated tube receiving recess 82, 100 is such that elongated recesses 110 on both sides of the tube spacer interface will be present. The recesses 110 correspond to the recesses 46 for receipt of the fingers 58, generally as shown in FIG. 8.

Figure 15:
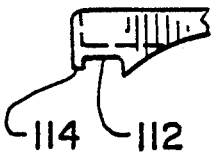
FIG. 15 illustrates still another embodiment of a spacer useful in the invention.

In some instances, each of the elongated recesses may be in the form of a pocket 112 as illustrated in FIG. 15 so as to provide an upstanding edge or flange 114 over which the fingers 58 may be hooked. This arrangement may be used when more positive attachment is required.

As alluded to previously, it is preferred that the radiator be assembled of entirely aluminum components. Brazing is a preferred mode of bonding and assembly and even more preferably, "NOCOLOK" ® brazing is utilized. To this end, where one component has an interface with another, one or the other or both will be braze clad with a braze clad alloy whose melting point is somewhat less than that of the base metal. Fluxes will be employed, which fluxes will typically be potassium-fluo-aluminate complexes as is well known.

It will be re appreciated that the invention provides a number of advantages. The use of cylindrical passages 34 maximizes pressure resistance within the headers while the use of the webs 90 accomplishes the same thing within the tubes 26. The fitting of the tube flanges 60 into recesses such as the recesses 50 or 102 provide a means whereby the sides of the recesses 50 or 102 may embrace and flank the flanges 62 surrounding the tube receiving slots 60. Consequently, the tube-to-header joints are not only reinforced by the presence of the flange 62, but also by the sides of the recesses 50, 102.

All in all, an extremely pressure resistant heat exchanger construction highly suitable for use in relatively high pressure engine coolant systems is provided.

Other advantages are also obtained. The construction reduces core breathing during pressure fluctuation, thereby minimizing the resulting fatigue. Because of the climination of gasketed interfaces, the all-aluminum construction thereby reduces susceptibility to crevice corrosion. Finally, the tanks are of sufficient size that they may be provided with an internal oil cooler if desired.

I claim:

1. A high pressure resistant aluminum radiator for cooling the coolant of an internal combustion engine and comprising a pair of generally cylindrical aluminum tubes, said tubes being spaced and parallel to one another;

end caps brazed within respective ends of said tubes to seal the same;

an elongated, aluminum, spacer on each of said tubes and extending the length thereof, the spacer on one of said tubes facing the spacer on the other of said tubes;

a plurality of spaced slots in each said spacer, the slots in each spacer being parallel and generally transverse to the direction of elongation of the associated spacer, the slots in one spacer further being aligned with corresponding slots in the other said spacer;

means establishing fluid communication between the corresponding tube and each of the slots in the associated spacer;

an aluminum header to each of said spacers, each header having a base provided with a plurality of elongated apertures surrounded by flanges, said apertures being aligned with corresponding slots in the associated spacer with said flanges entering the corresponding slots;

a plurality of flattened aluminum tubes received and extending between aligned apertures in said headers, the ends of said flattened tubes being brazed to the flanges surrounding the apertures in which they are received, said tubes including internal webs for increased pressure resistance; and a plurality of serpentine, aluminum fins extending between and brazed to adjacent ones of said tubes.

2. The high pressure resistant radiator of claim 1 wherein said spacers are integral with the corresponding tube, the tube and the spacer being defined by a single extrusion.

3. The high pressure resistant radiator of claim 2 wherein said slots are formed by circular saw cuts which further define said establishing means.

4. The high pressure resistant radiator of claim 2 wherein said slots are formed by end-mill cuts which further define said establishing means.

5. The high pressure resistant radiator of claim 1 wherein said spacers are formed separately from said tubes and are assembled thereto by brazing.

6. The high pressure resistant radiator of claim 5 wherein said establishing means comprise aligned passages in said tube and the slots of the associated header.

7. The high pressure resistant radiator of claim 1 wherein each said header includes legs extending from said base, each said spacer nesting between the legs of the corresponding header, the legs further being crimped around the corresponding spacer.

8. A heat exchanger comprising:

a core defined by a plurality of elongated, parallel spaced tubes with fins extending between adjacent tubes; and a header and tank assembly at least at one end of said core and attached thereto in fluid communication with said tubes, said assembly including:

an elongated housing including an interior passage having a cross-section defined by a closed curve and an exterior generally planar surface;

elongated recesses in the exterior of said housing, one to each side of said planar surface;

an elongated channel having spaced legs interconnected by a base, said channel being fitted to said housing with said base abutted to or adjacent to said planar surface;

and said legs extending partially about said housing to be received in said recesses;

means establishing fluid communication between said passage and said planar surface; and a plurality of openings in said base and tightly and sealingly receiving the ends of tubes in said core.

9. The heat exchanger of claim 8 wherein said tubes are flattened tubes and said openings are elongated slots surrounded by flanges.

10. The heat exchanger of claim 9 wherein said establishing means are elongated slots in said planar surface and said flanges are received in corresponding ones of the elongated slots in said planar surface.

11. The heat exchanger of claim 8 wherein said housing is generally of the shape of an "O" with a bar tangent thereto.

12. The heat exchanger of claim 10 wherein said elongated slots in said planar surface are curved and concave.

13. The heat exchanger of claim 10 wherein said elongated slots in said planar surface have flat bottoms.

14. The heat exchanger comprising:

a core defined by a plurality of elongated, parallel spaced tubes with fins extending between adjacent tubes; and a header and tank assembly at least at one end of said core and attached thereto in fluid communication with said tubes, said assembly including:

an elongated housing including an interior passage having a cross-section defined by a closed curve and an exterior, generally planar surface;

an elongated channel having spaced legs interconnected by a base, said channel being fitted to said housing with said base abutted to or adjacent to said planar surface and with said legs extending partially about said housing;

means establishing fluid communication between said passage and said planar surface; and a plurality of openings in said base and tightly and sealingly receiving the ends of tubes in said core.

15. The heat exchanger of claim 14 wherein said tubes are flattened tubes and said openings are elongated slots surrounded by flanges.

16. The heat exchanger of claim 15 wherein said establishing means are elongated slots in said planar surface and said flanges are received in corresponding ones of the elongated slots in said planar surface.

17. The heat exchanger of claim 14 wherein said housing is generally of the shape of an "O" with a bar tangent thereto, and said legs extend partially about the bar of said housing.

18. The heat exchanger of claim 16 wherein said elongated slots in said planar surface are curved and concave.

19. The heat exchanger of claim 16 wherein said elongated slots in said planar surface have flat bottoms.

* * * * *